US011927059B2

(12) United States Patent
Siegmann

(10) Patent No.: US 11,927,059 B2
(45) Date of Patent: Mar. 12, 2024

(54) DRILL ROD AND METHOD FOR RETROFITTING A KELLY BAR ARRANGEMENT

(71) Applicant: BAUER Maschinen GmbH, Schrobenhausen (DE)

(72) Inventor: Tobias Siegmann, Pöttmes (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 2 days.

(21) Appl. No.: 17/905,817

(22) PCT Filed: Jan. 26, 2021

(86) PCT No.: PCT/EP2021/051698
§ 371 (c)(1),
(2) Date: Sep. 7, 2022

(87) PCT Pub. No.: WO2021/185499
PCT Pub. Date: Sep. 23, 2021

(65) Prior Publication Data

US 2023/0123337 A1 Apr. 20, 2023

(30) Foreign Application Priority Data

Mar. 17, 2020 (EP) ..... 20163709

(51) Int. Cl.
*E21B 17/07* (2006.01)

(52) U.S. Cl.
CPC ..... *E21B 17/073* (2013.01)

(58) Field of Classification Search
CPC ..... E21B 17/07; E21B 17/05; E21B 17/073
See application file for complete search history.

(56) References Cited

U.S. PATENT DOCUMENTS 2,394,800 A 2/1946 Murphy
4,226,447 A * 10/1980 Brown ..... E21B 19/20 285/18

(Continued)

FOREIGN PATENT DOCUMENTS

EP 0 947 664 A2 10/1999
EP 2 821 585 A1 1/2015

(Continued)

OTHER PUBLICATIONS

International Preliminary Report On Patentability issued in PCT/EP2021/051698; issued Aug. 23, 2021.

(Continued)

*Primary Examiner* — Shane Bomar
(74) *Attorney, Agent, or Firm* — Studebaker & Brackett PC

(57) ABSTRACT

The invention relates to a drill rod for transferring a torque comprising an elongate rod base body, along which runs at least one base line for a fluid and/or electric current and/or data, an upper suspension device for suspending the drill rod from a support element, a rotary bearing, which is arranged between the suspension device and the rod base body, wherein the rod base body is mounted rotatably relative to the suspension device about a rod longitudinal axis, and a rotary feedthrough, through which a line connection is formed between at least one feed line, which is fixed relative to the support element, and the at least one base line of the rotatably-mounted rod base body. The invention is characterized here in that the rotary bearing is arranged axially distanced from the rotary feedthrough, and in that the rotary bearing comprises an axial bearing which is arranged above or below the rotary feedthrough. The invention furthermore relates to a drilling apparatus comprising such a drill rod and (Continued)

to a method for retrofitting an existing Kelly bar arrangement.

13 Claims, 7 Drawing Sheets

(56) References Cited

U.S. PATENT DOCUMENTS 4,904,119 A * 2/1990 Legendre ..... E21B 10/345 175/57
6,591,916 B1 * 7/2003 Ayling ..... E21B 33/068 175/218
2005/0274508 A1 * 12/2005 Folk ..... E21B 19/08 166/77.52
2006/0243490 A1 * 11/2006 Riel ..... E21B 7/04 175/203
2013/0105225 A1 * 5/2013 Koch ..... E21B 7/046 175/78
2015/0008040 A1 * 1/2015 Wiedenmann ..... E21B 19/02 175/57
2015/0337613 A1 * 11/2015 Belew ..... E21B 29/06 166/55.2
2022/0220814 A1 * 7/2022 Bauer ..... E21B 17/07

FOREIGN PATENT DOCUMENTS

JP 2009-299356 A 12/2009
WO 2021/032461 A1 2/2021

OTHER PUBLICATIONS

International Search Report issued in PCT/EP2021/051698; dated Apr. 13, 2021.

* cited by examiner

DRILL ROD AND METHOD FOR RETROFITTING A KELLY BAR ARRANGEMENT

The invention relates to a drill rod for transferring a torque, comprising an elongate rod main body, along which there runs at least one main line for a fluid and/or electric current and/or data, an upper suspension device for hanging the drill rod on a support element, a rotary bearing, which is arranged between the suspension device and the rod main body, wherein the rod main body is mounted rotatably relative to the suspension device about a rod longitudinal axis, and a rotary feedthrough, through which a line connection is formed between at least one feed line, which is fixed relative to the support element, and the at least one base line of the rotatably-mounted rod main body, according to the preamble of claim 1.

The invention also relates to a method for retrofitting a Kelly bar arrangement comprising a drill rod according to claim 14.

The invention relates to a drill rod which is mounted rotatably on a support element and has a rotary feedthrough, with which can be established a line connection between a fixed feed line and a base line running over the rotatable drill rod.

A drill rod of this kind is known from EP 2 821 585 A1. In the case of that drill rod a torque can be introduced directly at an outer side of the rod base body in the region of the rotary feedthrough. Regardless of the introduction of torque, an axial force, for example for lifting or lowering the drill rod, can be taken up via a support rope. The flow of force in this case runs directly via a rod-shaped connection element from a suspension device at the support rope, through the rotary feedthrough. In order to ensure sufficient functionality and tightness of the rotary feedthrough, this requires a particularly stable configuration of the rotary feedthrough, for example when a hydraulic fluid is conducted through, even under long-term rough construction operation.

The object of the invention is to describe a drill rod and a method for retrofitting a Kelly bar arrangement with which gentle and reliable operation of a drill rod can be achieved in a particularly efficient way.

The object is achieved on the one hand by a drill rod having the features of claim 1 and on the other hand by a method having the features of claim 14. Preferred embodiments of the invention are indicated in the dependent claims.

The drill rod according to the invention is characterized in that the pivot bearing is arranged axially distanced from the rotary feedthrough, and in that the pivot bearing comprises an axial bearing which is arranged above or below the rotary feedthrough.

A basic concept of the invention can be considered in that largely to relieve a rotary feedthrough at the drill rod from an axial force flow, so that protecting of the rotary feedthrough and in particular the seals provided therein can be achieved as a result.

According to one aspect of the invention the pivot bearing comprises an axial bearing which is arranged above or below the rotary feedthrough. The entire axial force flow or at least a substantial part of the axial force flow can thus be transferred via this axial bearing from the relatively fixed suspension device to the rod base body rotatable relative hereto. Correspondingly, the rotary feedthrough arranged therebelow or thereabove is correspondingly relieved of the load caused by this axial force flow. Potential load changes when the drill rod is lifted or lowered thus have no effect or only a small effect on the components of the rotary feedthrough rotatable relative to one another with the seals incorporated therein. This increases the service life of the seals, which in particular are elastomer deals with sealing lips.

A further aspect of the invention can be considered in that, due to the spatial and functional separation between the rotary feedthrough and the axial bearing, established or easily formed rotary feedthroughs and axial bearings can be used.

This reduces the manufacturing effort and the production costs. By means of such a rotary feedthrough, a reliable transfer of a fluid, which can be a liquid or a gas, as well as electrical current or data between a fixed element and a rotary element can be ensured.

A particularly stable embodiment of the invention lies in the fact that the rotary feedthrough comprises a sleeve-shaped outer part, which is connected to the rod base body torque proof, and an inner part, which is arranged within the outer part and is connected to the suspension device torque proof. In principle, however, the sleeve-shaped outer part of the rotary feedthrough could also be connected to a suspension device torque proof, whereas the inner part is connected to the rod base body. The base line and the feed line can be pipes, hoses, live cables or data-transmitting lines.

A particularly compact construction is achieved in accordance with a development of the invention in that the inner part of the rotary feedthrough is arranged on a spike-like portion of the suspension device, wherein the spike-like portion of the suspension device extends downwardly through the pivot bearing, which is configured in annular shape. A particularly good decoupling of the force transfer through the axial bearing and a line connection is thus ensured by the rotary feedthrough arranged therebeneath.

In principle, the at least one base line can run along an outer side of the rod base body. A particularly protected arrangement is achieved in accordance with an embodiment variant of the drill rod according to the invention in that the rod base body is designed tubular with a center cavity, and in that the at least one base line runs within the tubular rod base body. In particular in the case of drilling operation, the at least one base line is thus arranged in a particularly protected manner.

It is furthermore particularly expedient in accordance with one embodiment of the invention that the at least one base line opens out into a connection plate, which is arranged in an upper region of the rod base body. The connection plate represents a defined connection possibility on the rod base body. Correspondingly, a connection plate can also be provided at the lower end of the rod base body for the base line. A connection plate is particularly advantageous if a plurality of base lines is provided.

It is also expedient here that a connection device is provided, by means of which the connection plate is connected to the sleeve-shaped outer part of the rotary feedthrough, wherein a line connection between the base line in the rod base body and the feed line is formed on the support element. The connection plate and the connection device can be formed here in a module-like manner as plug components. The connection plate in this case comprises a predefined pattern of line openings, wherein corresponding openings for connection lines to the rotary feedthrough are provided on the connection device.

It is a preferred embodiment variant here of the drill rod according to the invention that the connection device comprises a basket-like insert with at least one connection line.

The connection lines can be formed in a flexible manner here and can thus ensure efficiently a connection to the rotary feedthrough.

It may be advantageous here that the basket-like insert comprises at least one form-fit element, by means of which a connection torque proof is formed between the connection plate and/or the sleeve-shaped outer part of the rotary feedthrough. The connection device thus produces not only a line connection, but also serves to provide a mechanical connection between the connection plate and the rotary feedthrough. The connection device can also serve here in particular as a type of adapter between the connection plate on a drill rod and a rotary feedthrough. If the rotary feedthrough changes, this may thus be sufficient to change and replace merely the connection device, accordingly.

A preferred embodiment of the invention furthermore lies in the fact that axially directed stop strips for torque transfer run on an outer side of the rod base body. The drill rod can be formed here in particular as a Kelly bar, in particular as a simple Kelly bar or as a Kelly bar for a telescopic Kelly bar arrangement. A torque can be transferred onto the drill rod from outside via the outer stop strips.

In a telescopic Kelly bar arrangement it is advantageous in accordance with a development of the invention that a plurality of outer drill rod pipes is provided. In this way, a multiple Kelly bar arrangement, for example having three of four Kelly bar elements, can be formed. In particular, larger drilling depths can be achieved with a multiple Kelly bar arrangement of this kind.

In principle, a rigid component, in particular a rod, can be used as a support element. In accordance with an embodiment variant of the invention, it is advantageous that the support element is a torsionally rigid support rope. The support rope can still be wound onto a winch, similarly to a standard support rope. The support rope is thus flexible in the longitudinal direction. It is designed torsionally rigidly in the circumferential direction, however, and therefore it can also be provided to absorb torques.

The invention also relates to a drilling apparatus having at least one drill rod as described above or a drill rod arrangement as described above, wherein a drilling tool with a line connection is attached releasably on the drill rod. In this case, the drilling tool can have at least one control component, which is actuated by a fluid, for example hydraulic liquid or pressurized air. Actively driven tools are also included here, for example rotary hammer drills with axially driven lift tappets. Pressurized air can also be provided for an air-lift method for removing drillings from the drilling tool. Alternatively or additionally, sensors or electrically actuated control elements can also be provided, which comprise a line connection for transferring electrical power and/or data. The drilling tool can be, in particular, a drilling bucket or a drilling auger with corresponding control elements and/or sensors.

The invention also relates to a method for retrofitting a Kelly bar arrangement, wherein an inner Kelly bar of an existing Kelly bar arrangement is replaced by the above-described drill rod. Existing Kelly bar arrangements, which are not usually intended or configured for a transfer of fluids, electrical current and/or data, can thus be retrofitted in this respect easily and efficiently. The above-described advantages result here from the drill rod according to the invention.

A preferred method variant of the invention lies here in the fact that with a multi-part Kelly bar arrangement with an inner Kelly bar, at least one intermediate Kelly pipe and an outer Kelly pipe, the inner Kelly bar and optionally at least one intermediate Kelly bar is replaced by a drill rod. For example, in the case of a triple Kelly bar, merely the inner Kelly bar can be replaced, and therefore a triple Kelly bar arrangement with three bar elements is still provided. Depending on the overall dimensions, however, also in a triple Kelly bar arrangement the intermediate Kelly pipe and the existing inner Kelly bar could be replaced by an inner Kelly bar according to the invention. A dual Kelly bar arrangement would thus be formed, which would consist merely of the provided outer Kelly pipe and the newly inserted drill rod according to the invention as inner Kelly bar.

The invention will be further described hereinafter on the basis of preferred exemplary embodiments shown in the drawings, in which.

Figures 1, 2:
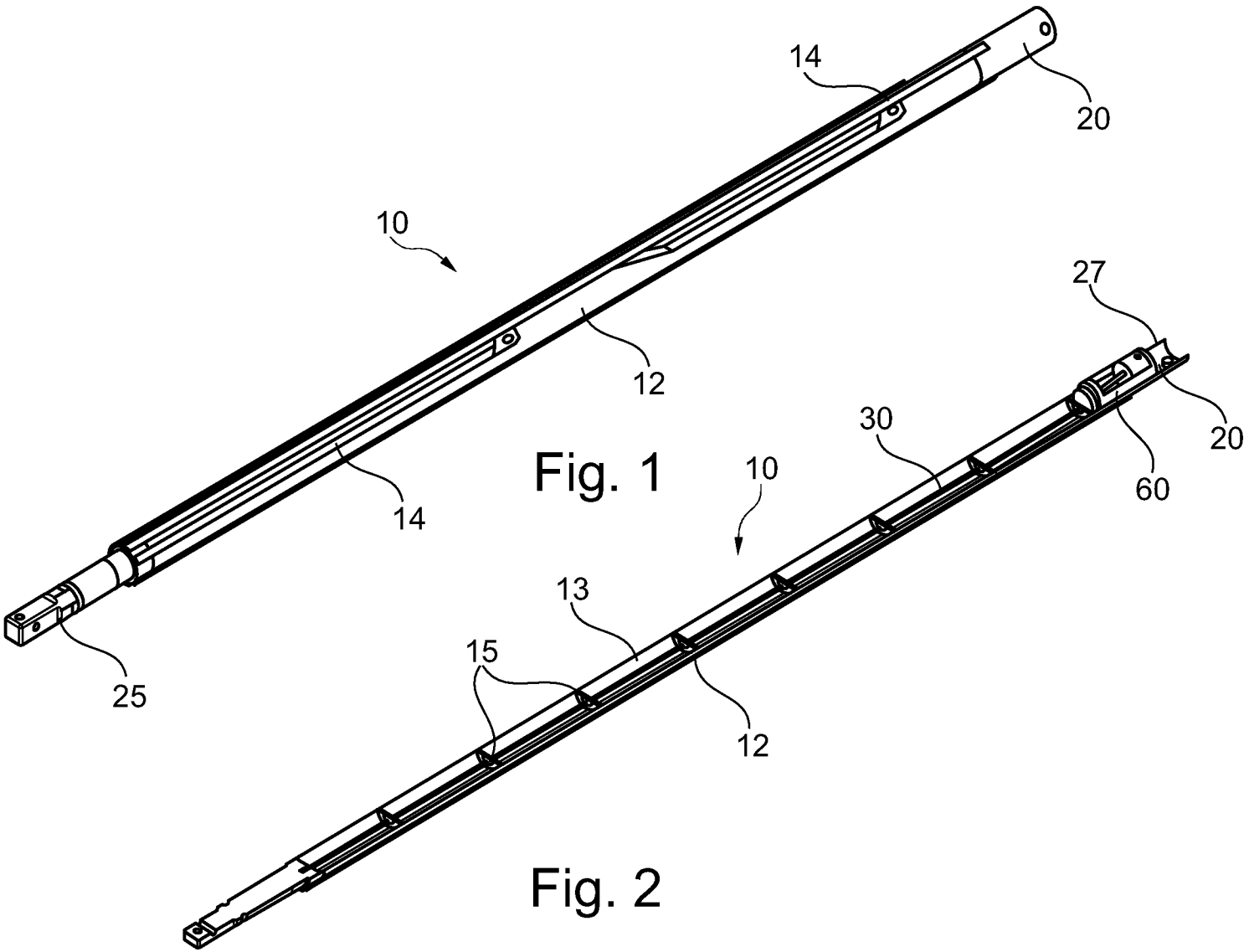
FIG. 1 shows a perspective view of a drill rod according to the invention.
FIG. 2 shows a cross-sectional view of the drill rod of FIG. 1.

An exemplary embodiment of a drill rod 10 according to the invention is illustrated in FIGS. 1 and 2. The drill rod 10 comprises an elongate rod-shaped base body 12, which is designed tubular with a center cavity 13. Stop strips 14 running in the longitudinal direction are mounted on the outer side of the rod base body 12 for torque transfer in accordance with a functionality of an inner Kelly bar.

At an upper end portion of the drill rod 10, a suspension device 20 shown only in part is provided, while a tool connection device 25 is provided on a lower end portion. The workpiece connection device 25 is provided with a square for a so-called Kelly box on a tool. In the region of the suspension device 20, a connection device 60 for a base line 30 is arranged within a tubular housing 27 and runs longitudinally along the center cavity 13 from the suspension device 20 to the tool connection device 25 and is supported via mounts 15. The connection device 60 will be described in greater detail hereinafter.

Figures 3, 4:
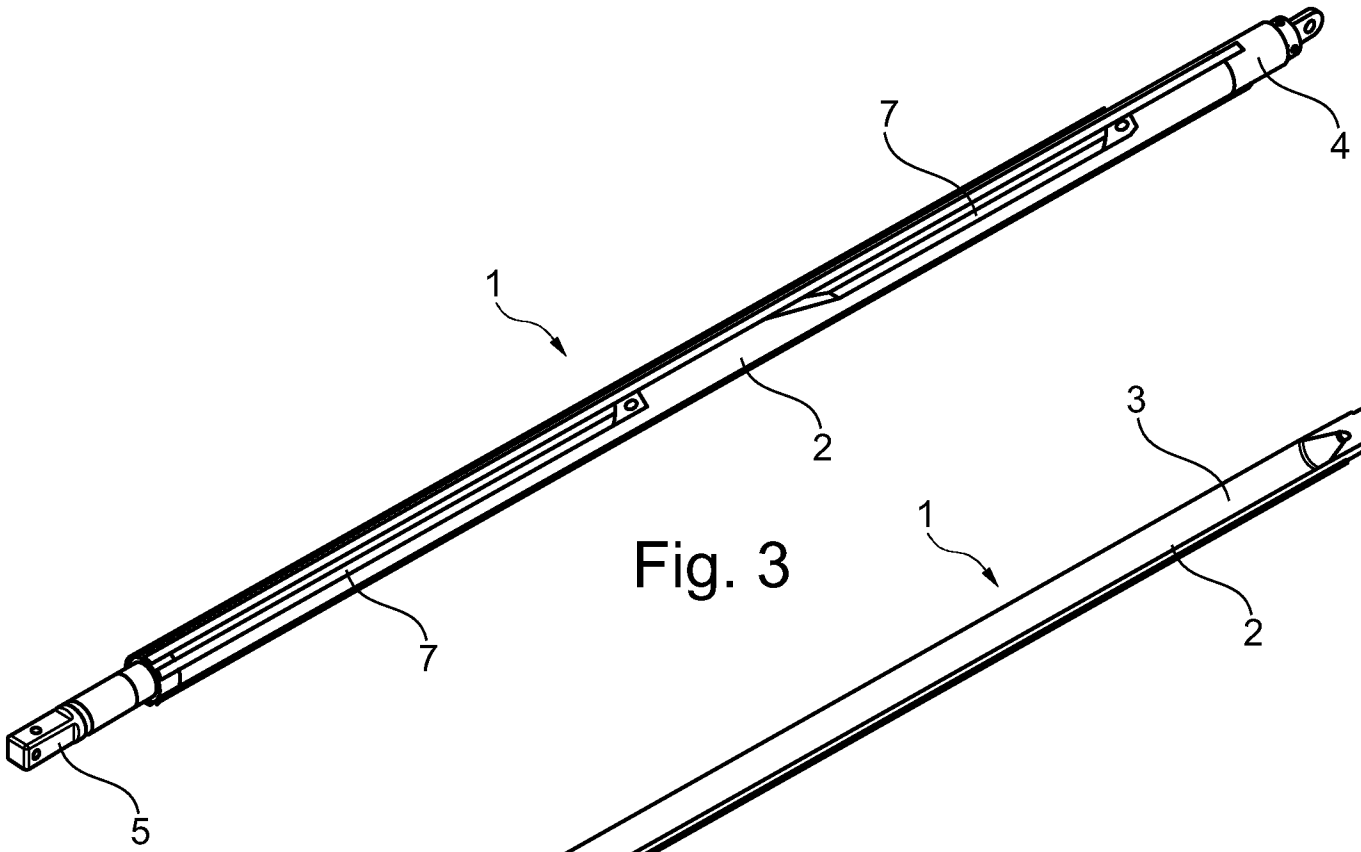
FIG. 3 shows a perspective view of a conventional inner Kelly bar.
FIG. 4 shows a cross-sectional view of the conventional inner Kelly bar of FIG. 3.

A comparison with a conventional inner Kelly bar 1, which is shown in FIGS. 3 and 4, reveals similarities and differences between this known prior art and the drill rod 10 according to the invention according to FIGS. 1 and 2. In a known inner Kelly bar 1 a rod-shaped base body 2 is likewise provided with outer strip-shaped stops 7 for a torque transfer. The inner Kelly bar 1 is likewise provided here with a suspension portion 4 at a upper end and a tool connection portion 5 at a lower end. The base body 2 of the inner Kelly bar 1 may furthermore likewise be designed tubular with a cavity 3, which in the case of a conventional inner Kelly bar 1 serves for reducing weight and otherwise has no function. Consequently, an existing inner Kelly bar 1 can be relatively easily retrofitted to a drill rod 10 according to the invention by replacing the end portions and laying one or more base lines 30 in the base body.

Figure 5:
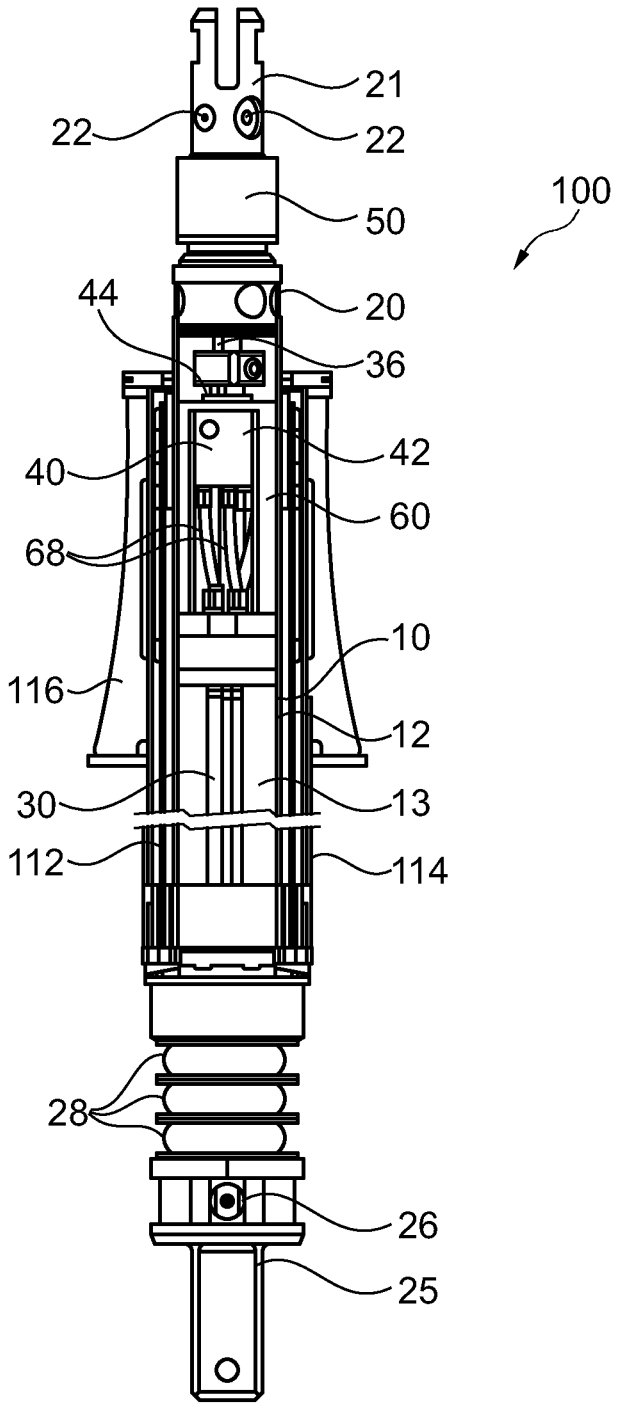
FIG. 5 shows a partly sectional and shorten illustration of a multiple Kelly bar arrangement with a drill rod according to the invention.

A Kelly bar arrangement 100 according to the invention with an inner drill rod 10 according to the invention, thus as described in conjunction with FIGS. 1 and 2, is illustrated in FIG. 5. Besides the drill rod 10 as inner Kelly bar, a first drill rod pipe 112, which forms an intermediate Kelly pipe, and an outer second drill rod pipe 114, which serves as an outer Kelly pipe, are provided. As is usual in the case of Kelly bars, the inner drill rod 10 and the second drill rod pipe 114 as well as the intermediate first drill rod pipe 112 can be moved axially to one another, so that on the whole a telescopic Kelly bar arrangement 100 is formed. A torque transfer between the individual Kelly bar elements can be provided here in basically known manner via inner and outer stop strips, wherein locking pockets for an axial locking can also be provided.

A collar-shaped stop ring 116 is mounted on the outer second drill rod pipe 114 and serves to put the Kelly bar arrangement 100 on an upper side of a rotary drive of a drilling apparatus. Furthermore, damping elements 28 made of a rubber material can be provided in a lower region in a manner known in principle, in order to cushion axial impacts between the inner drill rod 10 and the outer drill rod pipes 112 and 114.

A plurality of base lines 30 runs within the center cavity 13 of the tubular rod base body 12 of the drill rod 10. These open out in their lower region into radially directed line connections 28 at the lower tool connection device 25. Here, a ground processing tool, in particular a drilling tool, can be mounted torque proof via a Kelly connection, known in principle. Since the connected tool is connected torque proof, a corresponding line connection to the line connection 26 fixed relative hereto can be carried out relatively easily.

In its upper region, the base lines 30 open out into a connection device 60 with connection lines 68 running therein. The connection device 60 will be described in greater detail hereinafter in conjunction with FIG. 7.

At the upper end region of the connection device 60, there is arranged a rotary feedthrough 40, which has a pot-shaped or sleeve-shaped outer part 42. The outer part 42 is connected torque proof to the connection device 60 and the rod base body 12. Furthermore, the rotary feedthrough 40 comprises an inner part 44, which protrudes upwardly from the outer part 42 and is rotatable relative hereto. Intermediate lines 36 are connected to the inner part 44 and run upwardly through the annular rotary bearing 50 as far as a pin-shaped connection element 21, on which there are provided radially directed feed connections 22 for at least one supply line 82. The structure of the suspension device 20 with the suspension element 21 and the rotary bearing 50 will be explained further hereinafter in conjunction with FIG. 6.

Figure 6:
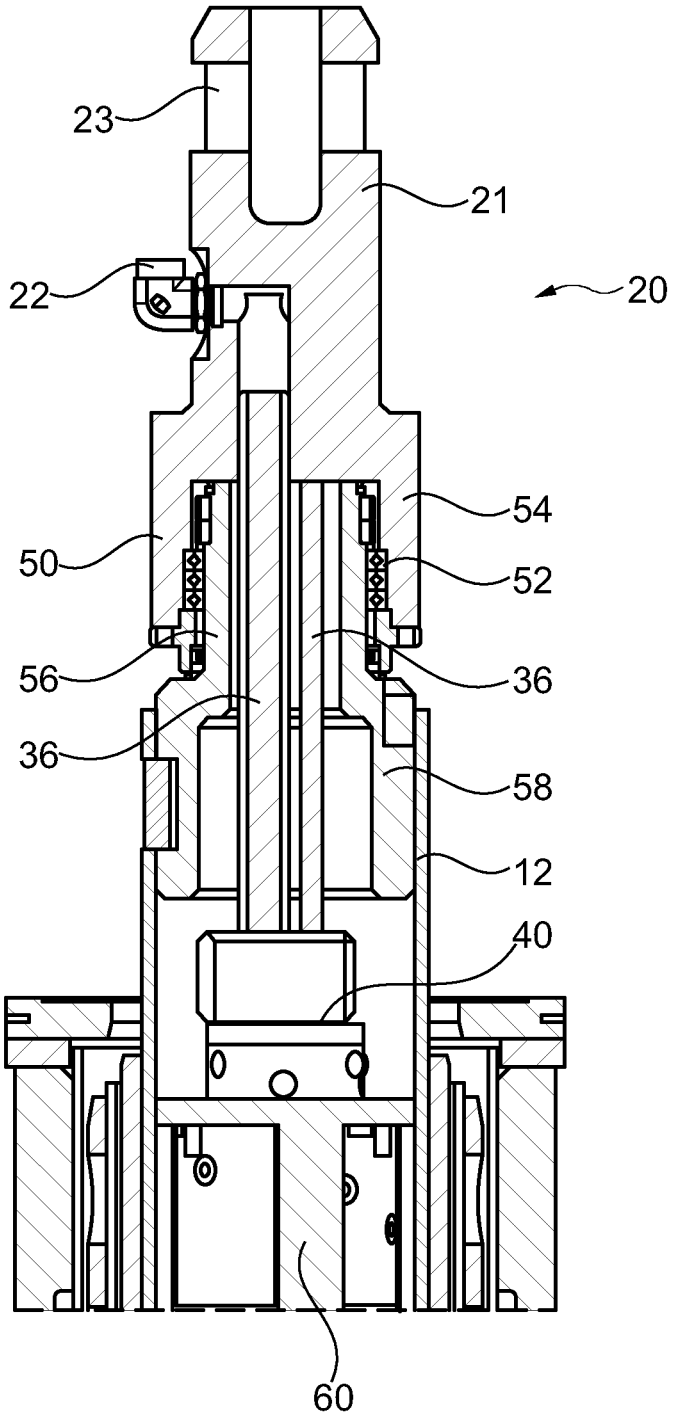
FIG. 6 shows a cross-sectional view of an upper region of a drill rod according to the invention.

According to FIG. 6, an upper region of the suspension device 20 is shown in cross section. The pin-shaped suspension element 21 has a transversely directed bolt receptacle 23 for a locking bolt, by means of which the suspension element 21 can be connected to a rope eye, not shown, of a support rope. The pin-shaped suspension element 21 is thus arranged in a fixed manner on a support element in the rotary direction about a longitudinal axis. In the shown exemplary embodiment, a fluid can be fed via the feed connection 22 via feed lines, which likewise are fixed, and can thus be conducted downward in the direction of the rotary feedthrough 40 via the intermediate lines 36.

At a lower end of the pin-shaped suspension element 21, there is formed a region of enlarged diameter, which forms a sleeve-like bearing housing 54 of the rotary bearing 50. Within the bearing housing 54, there is arranged an axial bearing 52, which in the shown exemplary embodiment is formed by three roller bearings. A tubular inner part 56 is mounted rotatably in the bearing housing 54 via the axial bearing 52. The bearing inner part 56 is thus mounted on the spike-like suspension element 21 and the internal intermediate lines 36 so as to be rotatable relative to the bearing housing 54.

The lower region of the tubular bearing inner part 56 is provided with a fastening portion 58, on which the rod base body 12 is mounted torque proof directly or via an intermediate element. In this way, a force flow can be established from the locking bolt via the suspension element 21 via the axial bearing 52 to the bearing inner part 56 rotatable hereto with the rod base body 12 fixedly mounted thereon.

A fluid course can be established from the feed connection 22 through the intermediate line 36 to the rod base body 12. It should be noted here on it that the intermediate lines 36 and the feed connections 22 are not used solely for a feed of a fluid from top to bottom to a tool, but can also be used correspondingly for the feed or return of fluid from the tool back upwardly to a support apparatus, for example if a hydraulic liquid is used as fluid.

Figure 7:
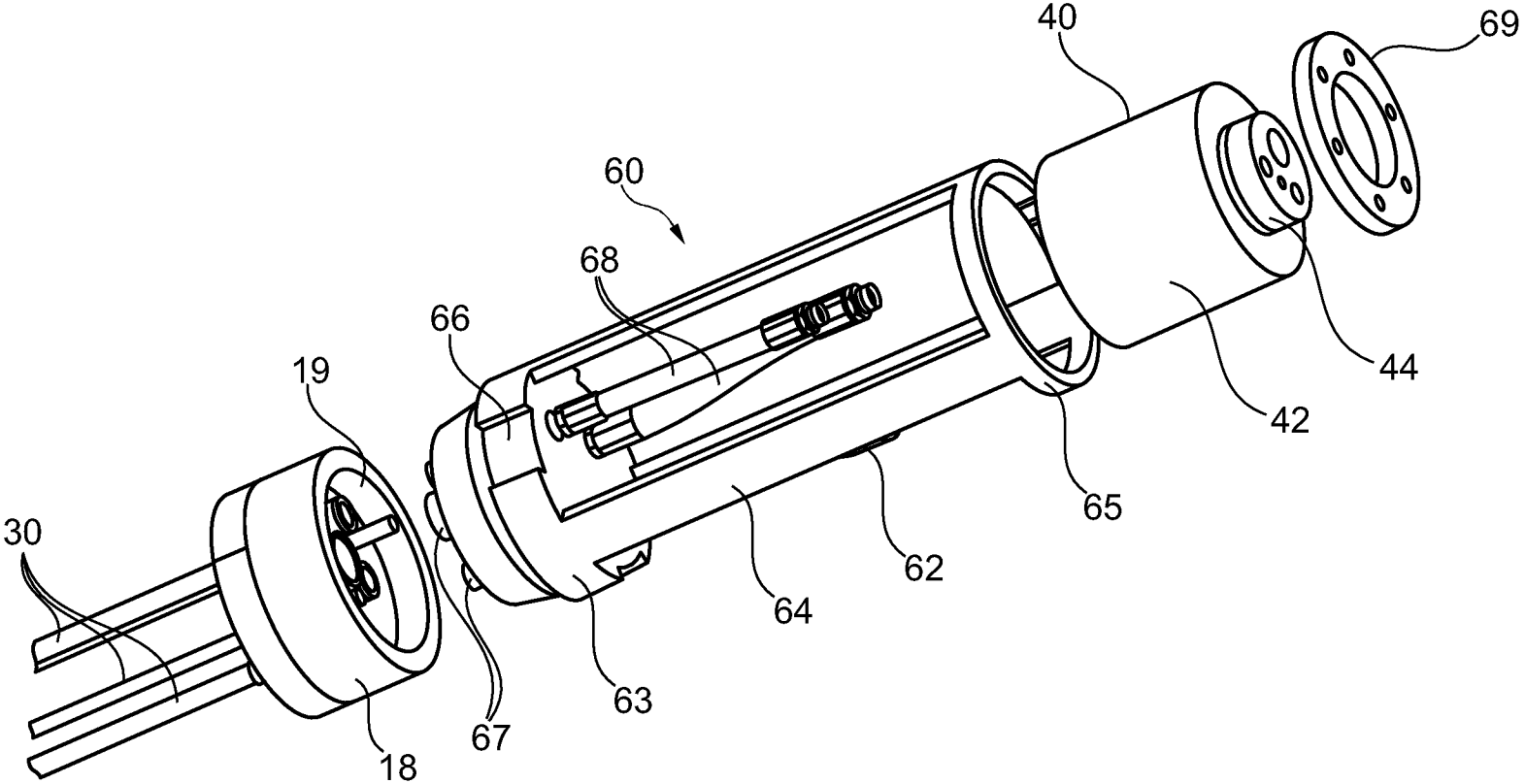
FIG. 7 shows a perspective detailed view of parts of the upper region of a drill rod according to the invention.

The connection device 60 is arranged in the rod base body 12 and will be explained in greater detail hereinafter in accordance with the illustration as per FIG. 7. The connection device 60 comprises, in particular, a basket-like insert 62 with a base 63 and longitudinal struts 64 extending therefrom in the longitudinal direction, which are stabilised at their upper end with a ring 65. The base lines 30 in the rod-shaped base body 12 open out into a connection plate 18, which is likewise arranged fixedly in the rod base body 12 and has an annular plug receptacle 19. A lower region of the base 63 of the basket-like insert 62 with lower connections 67 can be inserted axially in matching fashion into said receptacle, wherein a line connection is established between the base lines 30 and the intermediate lines 68 in the connection device 60. The upper ends of the connection lines 68 are connected fixedly to the underside of the sleeve- or pot-shaped outer part 42 of the rotary feedthrough 40. A line connection to the inner part 44 is produced within the rotary feedthrough 40, which inner part is rotatable relative to the sleeve-shaped outer part 42. The rotary feedthrough 40 can be configured to produce a line connection for a fluid, electrical current and/or data. The outer part 42 of the rotary feedthrough 40 is housed fixedly in the basket-like insert 62 via a closure ring 69, wherein the inner part 44 of smaller diameter protrudes through the passage of greater diameter in the closure ring 69. The above-described intermediate lines 36 can be connected to the upper side of the inner part 44 from the suspension element 21.

The connection device 60 is introduced into the rod-shaped base body 12 by being pushed axially into the latter, wherein a connection torque proof to the rod base body 12 is established via form-fit elements 66 on the base 63, which are configured as radial recesses. For this purpose, corresponding radial protrusions are provided on the rod base body 12, but these are not shown in the drawings.

Figure 8:
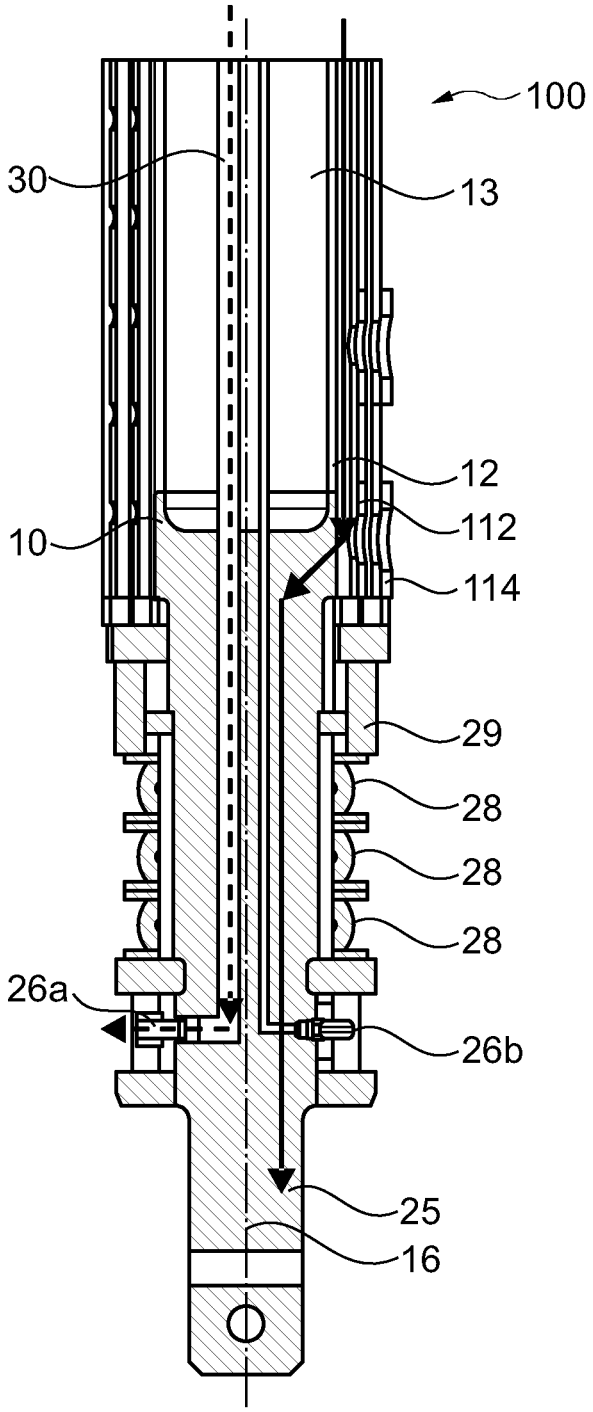
FIG. 8 shows a cross-sectional view of a lower region of the multiple Kelly bar arrangement of FIG. 5.

In the cross-sectional view according to FIG. 8, a lower end of a drill rod 10 according to the invention with a longitudinal axis 16 in a Kelly bar arrangement 100 is shown. The base lines 30 run within the bar base body 12 and in particular in the center cavity 13, until they open out into radially directed line connections 26 in the region of the tool connection device 25. Here, a left-hand line connection **26*a* is shown as a fluid connection, while the right-hand line connection 26*b*** is configured as a connection for electric current or a data line. A fluid flow is shown schematically by a dashed line, while a force flow is indicated by an arrow line.

In the shown exemplary embodiment, annular damping elements 28 made of rubber are arranged at the lower end region of the drill rod 10 and are supported on the one hand towards the bottom in relation to the tool connection device 25 and towards the top in relation to an attachment ring 29. A lower end of the first drill rod pipe 112 and of the second drill rod pipe 114 of the Kelly bar arrangement 100 lie on the attachment ring 29.

Figure 9:
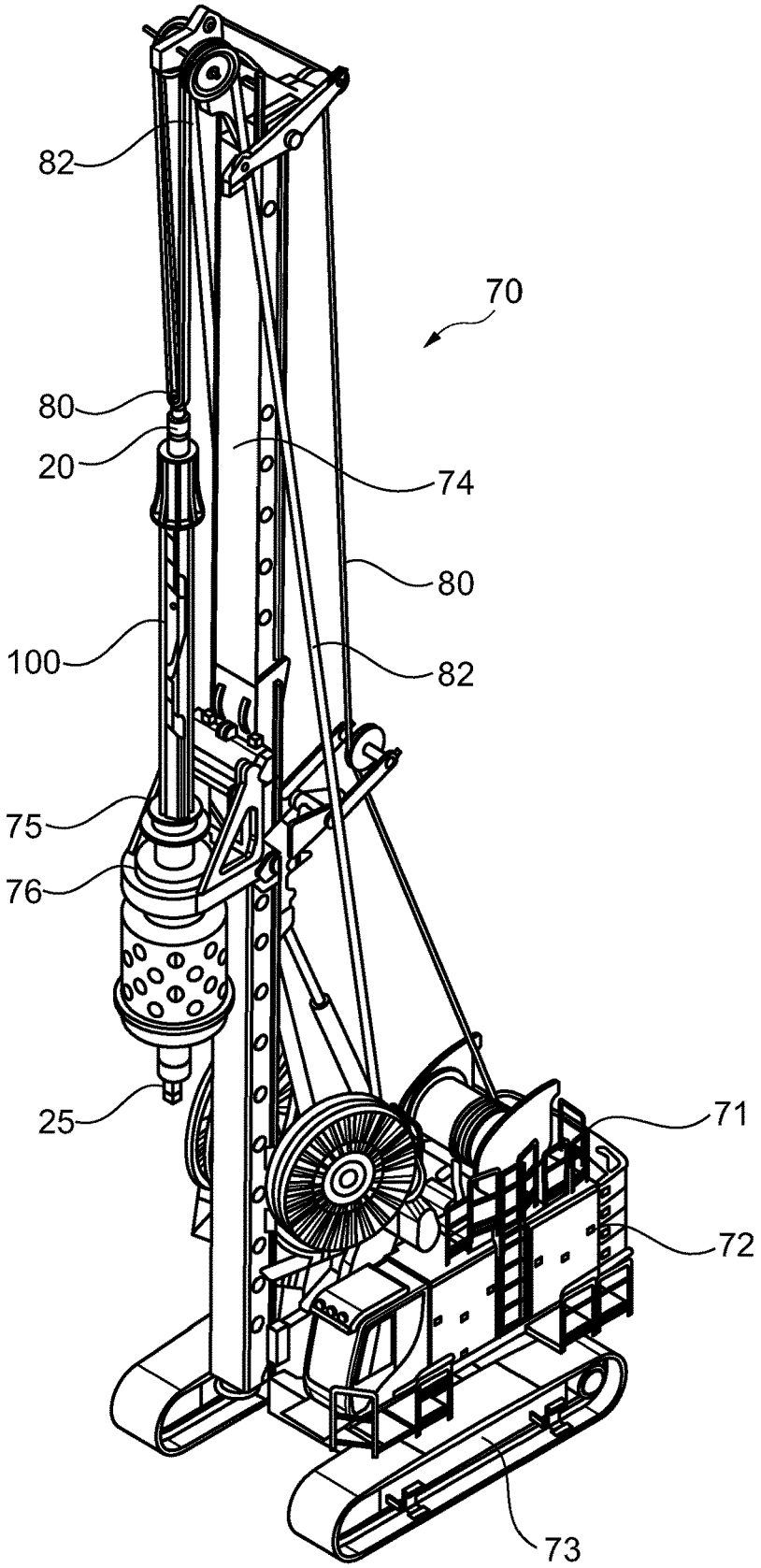
FIG. 9 shows a perspective view of a drilling apparatus according to the invention.

According to FIG. 9, a drilling apparatus 70 with a support apparatus 71 according to the invention is shown. The support apparatus 71 comprises an upper structure 72, which is mounted rotatably on a lower structure 73, which comprises a crawler chassis.

On the upper structure 72 there is mounted a substantially vertically directed mast 74, along which a drilling apparatus slide 75 with a rotary drive 76 is mounted displaceably. A Kelly bar arrangement 100 according to the invention is suspended via a support element 80 formed as a support rope and protrudes downwardly through the annular rotary drive 76. A drilling tool, not shown, for example a drilling bucket, can be mounted at a lower end of the Kelly bar arrangement 100 to a tool connection device 25. For example, hydraulic fluid can be feed from the support apparatus 71 via the suspension device 20 of the Kelly bar arrangement 100 and thus to a suspended drilling tool via at least one feed line 82.

The invention claimed is:

1. A drill rod for transferring a torque comprising an elongate rod base body, along which runs at least one base line for a fluid and/or electric current and/or data, an upper suspension device for suspending the drill rod from a support element, a rotary bearing, which is arranged between the suspension device and the rod base body, wherein the rod base body is mounted rotatably relative to the suspension device about a rod longitudinal axis, and a rotary feedthrough, through which a line connection is formed between at least one feed line, which is fixed relative to the support element, and the at least one base line of the rotatably-mounted rod base body, wherein the rotary bearing comprises an axial bearing which is arranged above or below the rotary feedthrough, wherein the rotary feedthrough and the rotary bearing, which comprises the axial bearing, are spatially and functionally separate, the rotary bearing is arranged axially distanced from the rotary feedthrough, the rotary feedthrough comprises a sleeve-shaped outer part, which is connected to the rod base body torque proof, and an inner part, which is arranged within the outer part and is connected to the suspension device torque proof, and the inner part of the rotary feedthrough is arranged on a spike-like portion of the suspension device, wherein the spike-like portion of the suspension device extends downwardly through the rotary bearing, which is configured in annular shape.

2. The drill rod according to claim 1, wherein the rod base body is tubular with a center cavity, and the at least one base line runs within the tubular rod base body.

3. The drill rod according to claim 2, wherein the at least one base line opens out into a connection plate, which is arranged on an upper region of the rod base body.

4. The drill rod according to claim 3, wherein a connection device is provided, by means of which the connection plate is connected to the sleeve-shaped outer part of the rotary feedthrough, wherein a line connection between the base line in the rod base body and the feed line is formed on the support element.

5. The drill rod according to claim 4, wherein the connection device comprises a basket-like insert with at least one connection line.

6. The drill rod according to claim 5, wherein the basket-like insert comprises at least one form-fit element, by means of which a torque proof connection is formed between the connection plate and/or the sleeve-shaped outer part of the rotary feedthrough.

7. The drill rod according to claim 1, wherein axially directed stop strips for torque transfer run on an outer side of the rod base body.

8. A drill rod arrangement having a drill rod according to claim 1, wherein at least one radially outer drill rod pipe is also provided, wherein, to form a telescopic Kelly bar arrangement, the drill rod is mounted torque proof, but axially displaceably in the at least one outer drill rod pipe.

9. The drill rod arrangement according to claim 8, wherein a plurality of outer drill rod pipes is provided.

10. The drill rod arrangement according to claim 8, wherein the support element is a torsionally rigid support rope.

11. A drilling apparatus having at least one drill rod according to claim 1, wherein a drilling tool with a line connection is attached releasably on the drill rod.

12. A method for retrofitting a Kelly bar arrangement, wherein an inner Kelly bar of an existing Kelly bar arrangement is replaced by a drill rod according to claim 1.

13. The method according to claim 12, wherein with a multiple Kelly bar arrangement with an inner Kelly bar, at least one intermediate Kelly pipe and an outer Kelly pipe, the inner Kelly bar or the inner Kelly bar and at least one intermediate Kelly pipe is replaced by the drill rod.

* * * * *